United States Patent [19]

Gelin

[11] Patent Number: 4,974,739

[45] Date of Patent: Dec. 4, 1990

[54] STORAGE TANK AND METHOD OF MAKING A STORAGE TANK

[75] Inventor: Robert J. Gelin, Newark, Ohio

[73] Assignee: Ozite Corporation, Libertyville, Ill.

[21] Appl. No.: 314,161

[22] Filed: Feb. 23, 1989

Related U.S. Application Data

[63] Continuation-in-part of Ser. No. 219,594, Jul. 15, 1988, abandoned.

[51] Int. Cl.[5] ..... B65D 25/00

[52] U.S. Cl. ..... 220/5 A; 220/452; 220/469

[58] Field of Search ..... 220/5 A, 1 B, 452, 469

[56] References Cited

U.S. PATENT DOCUMENTS

| | | | |
|---|---|---|---|
| 3,489,311 | 1/1970 | Folkerts et al. | 220/452 |
| 3,608,204 | 9/1971 | Ashby | 220/1 B X |
| 4,651,893 | 3/1987 | Mooney | 220/469 X |
| 4,754,136 | 6/1988 | Blakely . | |
| 4,817,817 | 4/1989 | Palazzo | 220/469 X |
| 4,844,287 | 7/1989 | Long | 220/5 A X |

OTHER PUBLICATIONS

Xerxes Century-Cast Brochure.
Xerxes Century-Cast Manual.
Product Sheet Entitled "The 30 Year Tanks" Xerxes Century-Cast Product Sheet Entitled The Fiberglass Tank Test That's Truly Above Ground Xerxes Century-Cast.

*Primary Examiner*—Steven M. Pollard
*Attorney, Agent, or Firm*—Wood, Phillips, Mason, Recktenwald & VanSanten

[57] ABSTRACT

A liquid storage tank having at least a liquid-retaining wall and usually a structural outer wall and including a porous material therebetween. The porous material forms a structural interconnection with the wall or walls to prevent them from peeling apart and is also typically adapted to wick any liquid which comes in contact with it. Further, the storage tank may have sensors associated with the porous material at strategic points for detecting the presence of a leak. A method of making a storage tank for a liquid is provided wherein at least a liquid-retaining wall and usually a structural outer wall is provided or formed. A porous material typically having a barrier layer formed on one surface thereof is applied to a surface of one of the walls by placing the surface opposite the barrier layer thereon. Further, at least one type of liquid sensor may be installed in the porous material at strategic points for detecting the presence of a leak in the storage tank.

36 Claims, 4 Drawing Sheets

STORAGE TANK AND METHOD OF MAKING A STORAGE TANK

RELATED APPLICATION

This is a continuation-in-part of application Ser. No. 219,594, filed July 15, 1988, now abandoned.

FIELD OF THE INVENTION

The present invention generally relates to storage tanks and methods of making storage tanks and, more particularly, to a storage tank formed in a manner so as to have enhanced structural and/or leak detection characteristics.

BACKGROUND OF THE INVENTION

In earlier years, storage tanks for liquids and particularly petroleum products such a gasoline consisted of large steel vessels that were buried in underground locations. Such tanks were well suited for their intended purpose when initially installed since the highly volatile contents were safely contained in a location were they were not readily subject to ignition by any external means which might otherwise cause a fire or explosion. However, after a number of years, such storage tanks would oftentimes deteriorate by reason of exposure to harsh environmental conditions.

When such deterioration would occur, the storage tank contents would leak from the tank at an unknown underground location. This would cause not only loss of the valuable contents, but also possible environmental contamination and the existence of a potentially hazardous condition. Equally important, ground water would leak into the underground tank causing a contamination of the liquid therein.

To overcome this problem, underground storage tanks have more recently been formed of various plastic materials that are less susceptible to deterioration. These tanks, when typically used for storing gasoline or other liquids, commonly have inner and outer walls spaced apart by a relatively great distance with the walls typically being reinforced by ribs therebetween, but such tanks have been undesirably large, heavy and require much more material for their construction. Moreover, ground water and/or gasoline may leak into the space between the inner and outer walls in the event of a defect in which case the leaking liquid will drain to the lower regions thereof.

With this dual-walled plastic construction, it is generally recognized that significant advances have been made over steel storage tanks in terms of long term avoidance of corrosion. It is nevertheless known that despite the advances to date, there is still a recurring problem of failure of the inner and/or outer walls of such storage tanks, not to mention transport and excavation problems. When this does occur in the field, the problem is serious due to the leakage of gasoline and/or ground water into the space between the two walls of the tank.

For this reason, it has been known to place sensors in the lower regions of the tank capable of providing warnings of leakage. This is, of course, desirable since it provides a warning of a most unsatisfactory condition and, furthermore, the sensors are such that the custodian of the tanks can actually tell whether the liquid leaking into the space between the walls is, for instance, ground water or gasoline. In such manner it is possible to know not only that there is a leak but also whether the leak is occurring in the inner or outer wall of the tank.

Unfortunately, such sensors do nothing toward eliminating the possibility of such leaks while also failing to provide a much more vital form of information to the custodian of the tank who is alerted to the existence of leakage between the walls. In particular, there has been no way to pinpoint the approximate location of the leak apart from whether it is in the inner or outer wall of the tank, and this has rendered repairs most time consuming and costly due to the need to search for the point of leakage before any repair can be made. In the case of the outer wall of the tank, this may require extensive excavation only after removal of large areas of concrete or asphalt covering the tank, which is obviously an undesirable undertaking.

The present invention is directed to overcoming one or more of the problems and accomplishing one or more of the objectives as aforementioned.

SUMMARY OF THE INVENTION

Accordingly, the present invention in one respect is directed to a storage tank for a liquid having an inner wall and an outer wall spaced from the inner wall. The storage tank has a porous material disposed between the inner and outer walls so as to be in intimate contact with both of them. The porous material is adapted to form a structural connection between the inner and outer walls, which are closely adjacent, to prevent the walls from peeling apart and, typically, the material is also adapted to wick any liquid coming in contact therewith. The storage tank may also include sensing means associated with the porous material at strategic points relative to the inner and outer walls for detecting the presence of a leak. With this arrangement, the storage tank further may include means associated with the sensing means for indicating the presence of the leak.

In the preferred embodiment, the porous material disposed between the inner and outer walls is a batt comprised of a needled non-woven fibrous composite material having inner and outer surfaces in intimate contact with the inner and outer walls. The batt is advantageously formed by applying to the composite material, either directly or indirectly, a fiber-coating binder that will serve to provide structural integrity between the inner and outer walls through the material. Preferably, the binder substantially coats fibers of the composite material and bonds the fibers together as well as to the inner and outer walls in a manner leaving small passages having a capillary characteristic between the coated and bonded fibers.

Moreover, the sensing means can advantageously comprise at least two different types of sensors with one type detecting the presence of one type liquid and another type detecting the presence of another type liquid. This arrangement allows the one type of sensor to detect the presence of the liquid in the storage tank in the event the liquid in the storage tank should leak through the inner wall. In similar fashion, the sensing means is such that the other type of sensor detects the presence of another liquid normally intended to be maintained outside the storage tank in the event the other liquid leaks through the outer wall.

In another respect, the present invention is directed to a storage tank for a liquid having a tank wall and a composite wall formed thereon. The composite wall comprises a porous material having a barrier layer formed on one surface thereof where the composite wall is applied to the tank wall by first spraying a liquid resin onto a surface of the tank wall and then placing the composite wall with the surface thereof opposite the barrier layer in contact with the liquid resin. Typically, the composite wall may be formed of a porous batt comprised of a needled non-woven fibrous composite material.

Further, the barrier layer is preferably formed prior to applying the composite wall to the tank wall by first coating the one surface of the composite wall with a liquid resin and then heating the one surface of the composite wall having the liquid resin thereon. To secure the composite wall to the tank wall, a first coat of the liquid resin is advantageously applied to the surface of the tank wall and allowed to set until it becomes tacky after which a second coat of the liquid resin is applied to the surface of the tank wall. In this manner, the tacky first coat of the liquid resin holds the composite wall or porous batt in place while the second coat of the liquid resin is penetrating into the composite wall or porous batt.

In a preferred embodiment, a second tank wall is formed on the composite wall. This may advantageously be done by first applying a first coat of a liquid resin to the barrier layer and thereafter applying a second coat of a liquid resin and chopped fiberglass to the barrier layer. In this manner, one of the tank walls will be an inner wall and one of the tank walls will be an outer wall.

More specifically, the barrier layer is preferably formed by first coating one surface of the composite wall or porous batt with a liquid resin after which that surface of the composite wall or porous batt is heated to cure the liquid resin. This barrier layer is such that an outer wall, for instance, may be formed on the composite wall or porous batt by first spraying the barrier layer with a first coat of a liquid resin and allowing it to set until it becomes tacky and thereafter spraying the barrier layer with chopped fiberglass and a second coat of a liquid resin. Due to the presence of the barrier layer on the surface of the composite wall or porous batt, the liquid resin utilized in forming the outer wall is restricted from penetrating into the porous material.

In accordance with still another aspect of the invention, a method of making a storage tank for a liquid is provided which comprises the step of first laying up a shell forming one wall of the tank. The method also includes the steps of applying a porous material adapted to wick any liquid coming in contact therewith to one surface of the wall of the tank, laying up another shell on the porous material to form another wall of the tank and, if desired, installing at least one type of liquid sensor between the shells at strategic points for detecting the presence of a leak. Preferably, the porous material is a batt formed of a needled non-woven fibrous composite material having inner and outer surfaces.

With regard to the inventive method, the batt is preferably applied to the one wall of the tank by placing one of the surfaces of the batt in contact with the one surface of that wall of the tank. Preferably, the method includes the steps of first applying a binder to the one surface of the one wall of the tank and later applying a binder to the one of the surfaces of the batt not in contact with the one surface of the one wall of the tank. Subsequently, the other wall of the tank is laid up on the on surface of the batt not in contact with the one surface of the one wall of the tank.

Alternatively, the method includes the step of first saturating the batt with a fiber-coating binder to substantially coat fibers of the composite material to bond them together. The method then also preferably includes the step of removing excess fiber-coating binder from the batt by compressing the batt after saturation. In this manner, the fibers will be coated and bonded so as to leave small passages having a capillary characteristic to wick any liquid coming into contact with the batt.

Additionally, the method preferably includes the step of forming a skin on the one of the surfaces of the batt which is not in contact with the one surface of the one wall of the tank. The step of laying up the other shell on the batt is then advantageously performed before the fiber-coating binder completely cures. More particularly, the other shell is laid up on the skin which serves as a form wherein the batt is in intimate contact with both shells as the binder cures.

Alternatively, the method may include the step of removing excess fiber-coating binder from the batt by allowing a solvent in the binder to evaporate after saturation to ensure that the fibers are coated and bonded in a manner leaving the small capillary-like passages.

In accordance with still another aspect of the invention, a method of making a storage tank for a liquid is provided which comprises the step of providing a tank wall and a porous material. The method also includes the steps of forming a barrier layer on the porous material substantially reducing porosity of one surface thereof, applying a liquid resin to a surface of the tank wall, and placing the surface of the porous material opposite the barrier layer in contact with the liquid resin whereby the porous material and liquid resin form a composite wall on the liquid-retaining wall. Preferably, the porous material is a batt formed of a needled non-woven fibrous composite material.

With regard to this aspect of the invention, the resin applying step preferably includes applying a first coat of the liquid resin onto the surface of the tank wall, allowing the first coat to set until it becomes tacky, and applying a second coat of the liquid resin onto the surface of the tank wall. The porous material is then advantageously placed in contact with the liquid resin such so as to be held in place by the tacky first coat of the liquid resin while the second coat of the liquid resin is penetrating into the porous material to structurally bond together fibers thereof. Further, the method may advantageously include the step of forming a second tank wall on the composite wall by first applying a first coat of liquid resin to the barrier layer followed by a second coat of liquid resin and chopped fiberglass.

Other objects, advantages and features of the present invention will become apparent from a consideration of the following specification taken in conjunction with the accompanying drawings.

DETAILED DESCRIPTION OF THE PREFERRED EMBODIMENTS

Figure 1:
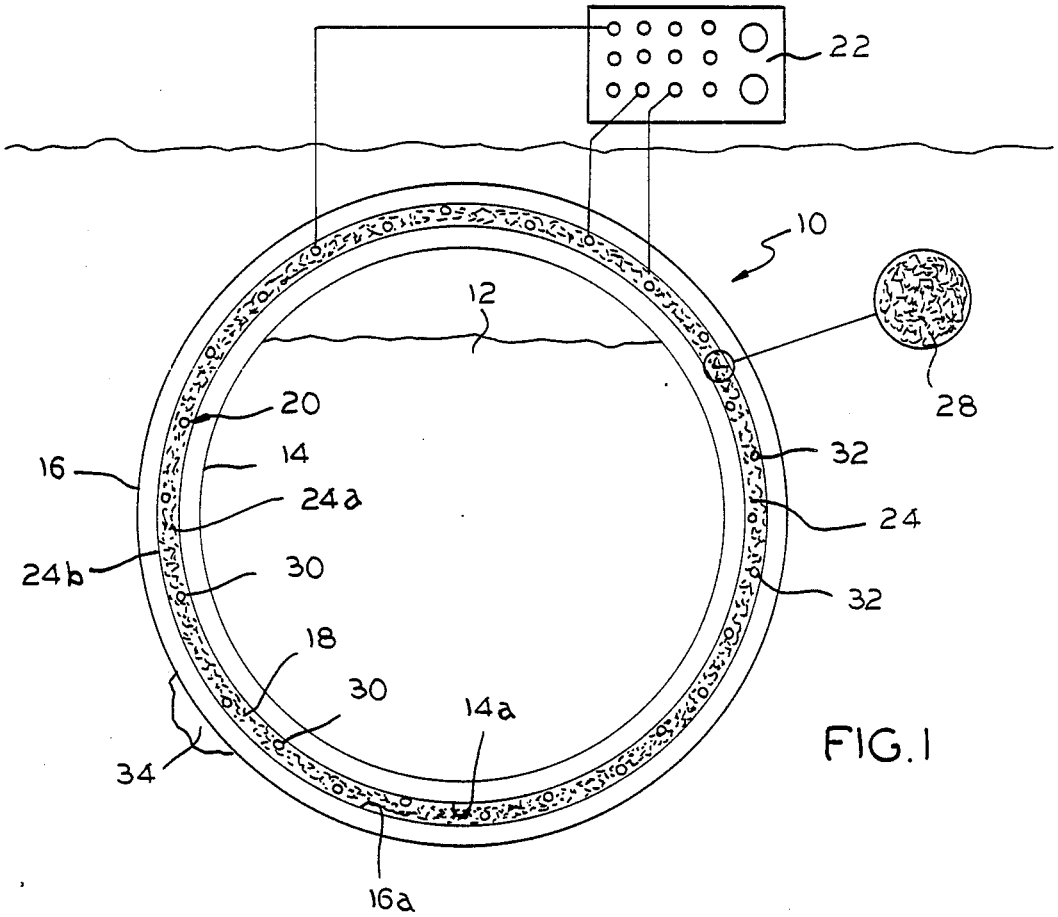
FIG. 1 is a cross sectional view of a liquid storage tank having a leak detection system in accordance with the present invention.
Figure 2:
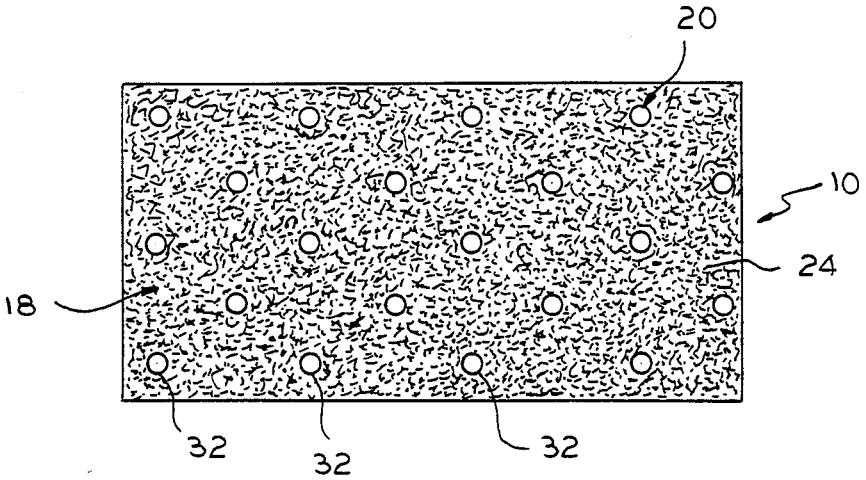
FIG. 2 is a side elevational view of the liquid storage tank of FIG. 1 with the outer wall removed to illustrate certain aspects of the leak detection system.

Referring to the drawings, and first to FIG. 1, the reference numeral 10 designates generally a storage tank for a liquid 12 having an inner wall 14 and an outer wall 16 spaced from the inner wall. The storage tank 10 has a porous material 18 disposed between the inner and outer walls 14 and 16 so as to be in intimate contact therewith. The porous material 18 is adapted to form a structural interconnection or bond between the inner and outer walls 14 and 16, which are closely adjacent, to prevent the walls from peeling apart and, typically, the material is also adapted to wick any liquid such as 12 coming in contact therewith. The storage tank 10 also preferably has sensing means generally designated 20 which are associated with the porous material 18 at strategic points relative to the inner and outer walls 14 and 16. Further, the storage tank 10 has means associated with the sensing means 20, such as a monitor or indicator 22, which serves to indicate the presence of a leak through either of the inner and outer walls 14 and 16.

Figure 7:
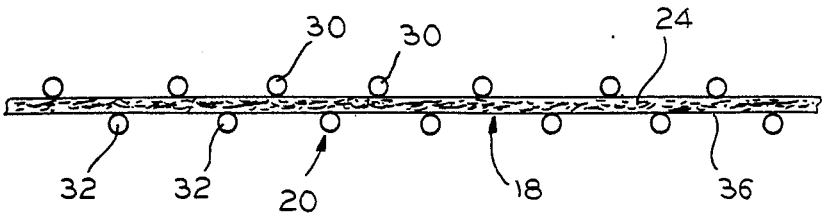
FIG. 7 is a side elevational view of a batt having liquid sensors installed therein for use in the leak detection system for the liquid storage tank of the present invention.

Preferably, the porous material 18 disposed between the inner and outer walls 14 and 16 is a batt 24 (see also FIG. 7) comprised of a needled non-woven fibrous composite material having inner and outer surfaces 24*a* and 24*b*. It will be apparent from FIG. 1 that the batt 24 which has first been saturated with a fiber-coating binder 26 (see also FIG. 5) is such that the inner and outer surfaces 24*a* and 24*b* are in intimate contact with the respective inner and outer walls 14 and 16 of the storage tank 10. In this connection, the binder 26 is applied to the batt 24 so as to coat fibers of the composite material to bond them together as well as to the inner and outer walls 14 and 16 while leaving small passages 28 having a capillary characteristic between the coated and bonded fibers.

In a preferred embodiment, the sensing means 20 includes at least one and preferably two different types of sensors 30 and 32 with one type of sensor 30 detecting the presence of one type liquid 12 and another type of sensor 32 detecting the presence of another type liquid 34. The one type of sensor 30 detects the presence of the type of liquid 12 in the storage tank 10 in the event the liquid in the storage tank should leak through the inner wall 14. In similar fashion, the other type of sensor 32 detects the presence of the other type of liquid 34 normally intended to be maintained outside the storage tank 10 in the event the other type of liquid 34 should leak through the outer wall 16.

As for the exact number and placement of the sensors 30 and 32, this will depend upon a balance of cost against the need for accurate detection of leak location.

As will be appreciated from FIG. 1, the batt 24 has its inner and outer surfaces 24*a* and 24*b* in intimate contact with confronting closely spaced apart surfaces 14*a* and 16*a* of the inner and outer walls 14 and 16, respectively. It is advantageous for the sensors 30 and 32 to be mounted at strategic points about both the inner and outer surfaces 24*a* and 24*b* of the batt 24 for detecting the presence, respectively, of any of the liquid 12 or any of the liquid 34 leaking through the respective inner and outer walls 14 and 16 of the tank 10. By providing a suitable monitor or indicator 22, not only the presence of either of the two types of liquids 12 and 34 between the inner and outer walls 14 and 16 but, to pinpoint the leak, the exact location of either of the liquids between the inner and outer walls 14 and 16 can also be determined accurately.

Figure 3:
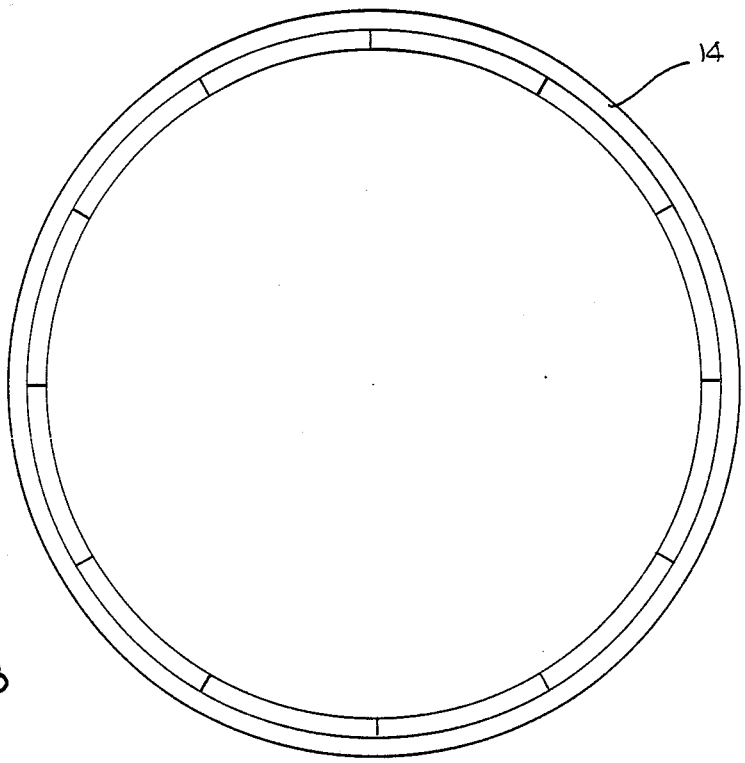
FIG. 3 is a cross sectional view illustrating a first step in a method of making a liquid storage tank having a leak detection system in accordance with the present invention.
Figure 8A:
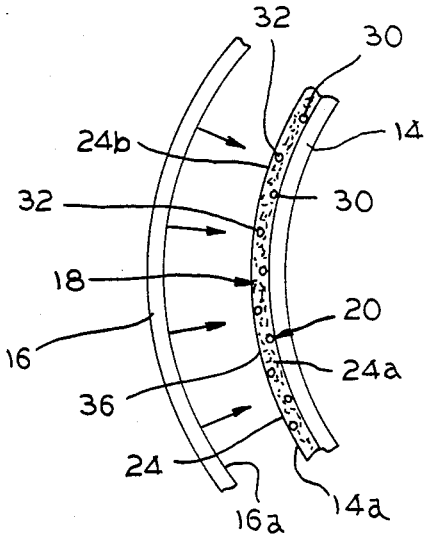
FIG. 8*a* is a partial cross sectional view illustrating a final step in the method of making a storage tank in one manner according to the present invention.
Figure 8B:
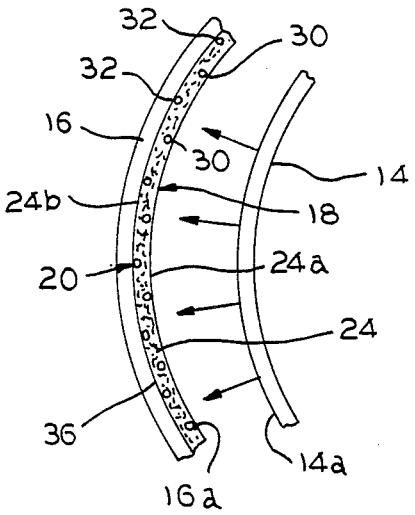
FIG. 8*b* is a partial cross sectional view illustrating a final step of the method of making a storage tank in another manner according to the present invention.

Referring to FIGS. 3 and 8*a*, the method of making the storage tank 10 for the liquid 12 can be understood as comprising the step of first laying up a shell forming one wall 14 of the tank 10, e.g., on a form. The method also includes the steps of next applying the porous material 18 to one surface 14*a* of the wall 14 of the tank 10, and then laying up another shell on the porous material 18 to form another wall 16 of the tank 10. Optionally, the method may include the step of installing at least one type of liquid sensor 30 and/or 32 between the shells or walls 14 and 16 at strategic points for detecting the presence of a leak.

As previously mentioned, the porous material 18 is preferably a batt 24 applied by placing one of the surfaces 24*a* of the batt 24 in contact with the surface 14*a* of the wall 14. This is preferably done in conjunction with a step of forming a structural bond by substantially coating fibers of the porous material 18 comprising the batt 24 with the fiber-coating binder 26 to bond the fibers together and to the inner and outer walls 14 and 16. In one preferred method, the structural bond is formed by first applying binder as, for example, by spraying to the one surface 14*a* of the one wall 14 of the tank 10. This step is then followed by applying the one surface 24*a* of the batt 24 to the binder coated surface 14*a* after which the binder 26 is applied to the other surface 24*b* of the batt 24. After this has been completed, the other wall 16 is formed on the other surface 24*b* of the batt 24 to complete the steps required to form the liquid storage tank 10.

Figure 5:
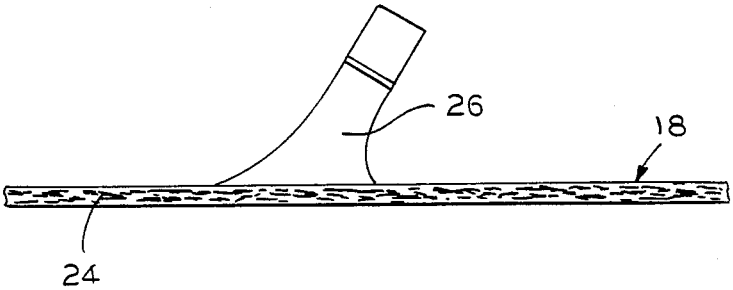
FIG. 5 is a schematic illustration of a second step in forming a batt for use in the leak detection system for the liquid storage tank of the present invention.
Figure 6:
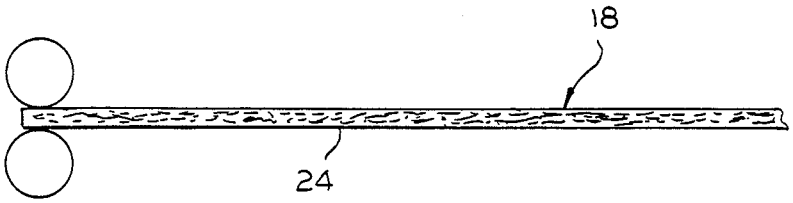
FIG. 6 is a schematic illustration of a third step in forming a batt for use in the leak detection system for the liquid storage tank of the present invention.

Alternatively, the method may include the step of first saturating the batt 24 with the fiber-coating binder 26 to substantially coat fibers of the composite material and bond them together in a manner leaving small passages 28 having a capillary characteristic between the coated and bonded fibers (see FIG. 5). The method then further preferably includes the step of next removing excess fiber-coating binder 26 from the batt 24 by compressing the batt after saturation to ensure that the fibers are coated and bonded in a manner leaving the small passages 28 having a capillary characteristic to wick any liquid coming into contact with the batt (see FIG. 6). It should be appreciated that, by "saturation", it is meant that all fibers are coated while leaving the capillary passages after removing the excess binder 26. The method then also preferably includes the step of applying the batt 24 to the surface 14*a* of the wall 14 at a point in time before the fiber-coating binder 26 has cured after which a skin 36 is formed on the surface 24*b* of the batt 24. Finally, the method of the present invention will then again preferably include the step of laying up the other shell or wall 16 on the skin 36 of the batt 24 while the batt at a point in time before the fiber-coating binder 26 has cured.

Another alternative includes the step of removing excess fiber-coating binder 26 from the batt 24 by allowing a solvent in the binder 26 to evaporate after saturation to ensure that the fibers in the batt 24 are coated and bonded together while leaving the capillary passages 28.

Still another alternative includes the step of first forming a film on one surface (such as 24*b*) of the batt 24 capable of resisting penetration of the fiber-coating binder 26 and then applying the binder 26 to the other surface (such as 24*a*) of the batt 24 to substantially coat fibers of the batt 24 to bind the fibers together and to only one of the walls 14 and 16.

As previously suggested, the method may further preferably include the step of installing at least two types of liquid sensors 30 and 32 between the shells or walls 14 and 16. One type of sensor 30 detects the presence of one type liquid 12 and the other type of sensor 32 detects the presence of another type liquid 34. As will be appreciated by referring to FIG. 1, the method preferably includes the further step of connecting the two types of liquid sensors 30 and 32 to the monitor or indicator 22.

Figure 4:
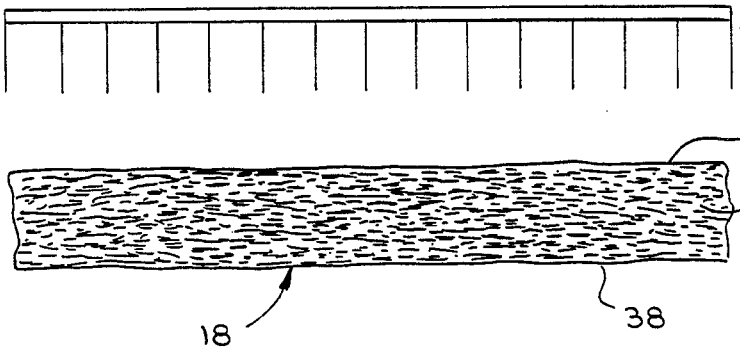
FIG. 4 is a schematic illustration of a first step in forming a batt for use in the leak detection system for the liquid storage tank of the present invention.

As shown in FIG. 4, the batt 24 is preferably formed in accordance with commonly owned and earlier filed patent applications U.S. Ser. Nos. 939,052 and 069,826, filed on Dec. 8, 1986 and July 6, 1987. This may be done, for instance, as schematically represented in FIG. 4 wherein a substrate of non-woven material 38 is covered with a layer of mineral fibers 40 which, in turn, is covered by a top layer of fibers less than approximately 7 inches in length, for instance, polyester. When this is done, the non-woven fiber composite material is needled by the apparatus schematically represented at 42.

While the unique construction of a liquid storage tank 10 has been illustrated in an underground environment, it will be appreciated that it can also be utilized for above ground liquid storage tanks as well. In fact, the applications for a tank having the structural integrity of the present invention and for the leak detection system disclosed herein are not limited in any sense but, rather, can be advantageously utilized wherever strong storage tanks are needed and where leakage through a tank surface may be anticipated rendering it desirable to detect not only the existence of leakage but also the precise location. Similarly, the mention of gasoline storage tanks is merely for purposes of illustration and not limitation as the storage tank is suitable for use with any liquid.

With regard to the skin 36 on the surface 24*b* of the batt 24, it may be formed using a plasticizer or a heat seal technique. In fact, any method of forming a skin on the given material may be utilized with the only requirement being that it is the surface upon which the second shell or wall will be laid up that will be provided with the skin 36 which provides a nearly immediate ability to form the second shell or wall without delay since the batt may then comprise the reinforcement between the inner and outer walls. As an alternative, conventional reinforcement may be provided between the inner and outer walls in which case it is not as advantageous to first form the skin 36 on the batt 24.

Preferably, the binder to be utilized in readying the batt for use will be of the same type utilized to form the shells or walls of the liquid storage tank. For instance, it may suitably comprise a polyester resin. In practice, it has been found that the binder merely forms a film around the fibers to form even better capillary passages than before its application.

With regard to the sensors, separate sensors 30 and 32 have been illustrated in the drawings, although it should be appreciated by those skilled in the art that the sensors could be dual-function sensors. Such dual-function sensors, which are conventional and known in the art, are capable of accurately determining the type of liquid in contact therewith and sending a signal to the monitor or indicator 22. Since such sensors are known in the art, and are presently utilized in connection with storage tanks of the type contemplated in the invention, they will not be described in detail herein.

Figure 9:
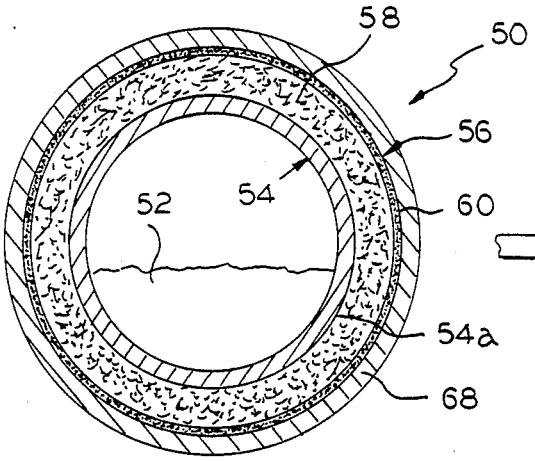
FIG. 9 is a cross sectional view illustrating another liquid storage tank in accordance with the present invention.

Referring to FIG. 9, an alternative embodiment of storage tank 50 for holding and storing a liquid 52 is disclosed. The storage tank 50 includes a tank wall generally designated 54 and a composite wall generally designated 56. The composite wall 56 comprises a porous material 58 having a barrier layer 60 formed on one surface thereof such that the composite wall 56 can be applied to the tank wall 54 and, thus, formed thereon by first applying a liquid resin 59 (see FIG. 10*a*) by any suitable means such as spraying or utilizing a pressure roller to a surface 54*a* of the tank wall 54. The composite wall 56 is then placed with the surface thereof opposite the barrier layer 60 in contact with the liquid resin 59 on the surface 54*a* of the tank wall 54. Preferably, the composite wall 56 comprises a porous batt formed of a needled non-woven fibrous composite material.

Figure 11A:
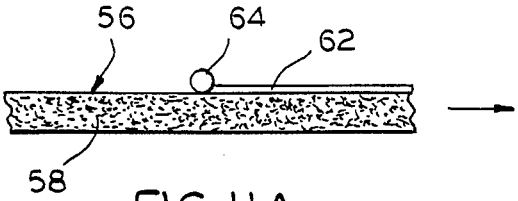
FIG. 11*a* is a schematic illustration of a first step in forming a porous batt for the liquid storage tank of FIG. 9.
Figure 11B:
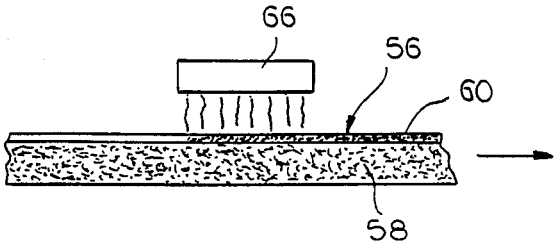
FIG. 11*b* is a schematic illustration of a second step in forming a porous batt for the liquid storage tank of FIG. 9.

As shown in FIG. 11*a*, the barrier layer 60 is preferably formed prior to applying the composite wall or porous batt 56 to the liquid-retaining wall 54. More specifically, the barrier layer 60 is formed by first coating the one surface of the composite wall or porous batt 56 with a liquid resin such as a latex resin as at 62 which can be done, by way of example, by utilizing a conventional roll coating device 64. Thereafter, a heater 66 is utilized to heat the surface of the composite wall or porous batt 56 having the liquid resin 62 as shown in FIG. 11*b*.

Once this has been done, the porous batt 56 is ready to be applied to the liquid-retaining wall 54 by any suitable means.

Figure 10A:
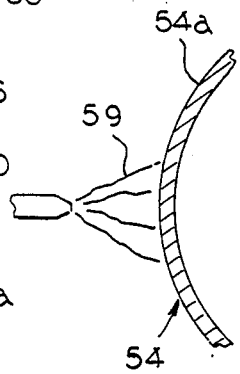
FIG. 10*a* is a partial cross sectional view illustrating a first step in another method of making a liquid storage tank in accordance with the present invention.
Figure 10B:
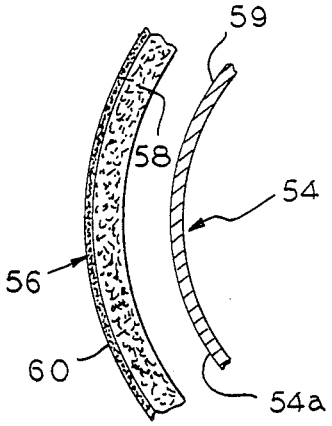
FIG. 10*b* is a partial cross sectional view illustrating another step in the method of making a liquid storage tank in accordance with FIG. 10*a;*
Figure 10C:
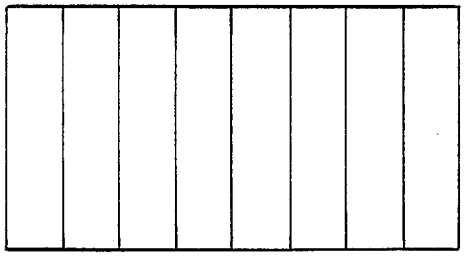
FIG. 10*c* is a side elevational view illustrating yet another step in the method of making a liquid storage tank in accordance with FIG. 10*a;*

Referring specifically to FIG. 10*a*, a first coat of the liquid resin 59 is applied to the surface 54*a* of the tank wall 54 and allowed to set until it becomes tacky. Next, a second coat of the liquid resin 59 is applied to the surface 54*a* of the tank wall 54. At this point, the composite wall or porous batt 56 will be held in place by the tacky first coat of the liquid resin 59 while the liquid second coat of the resin 59 is penetrating into the porous material 58.

Figure 10D:
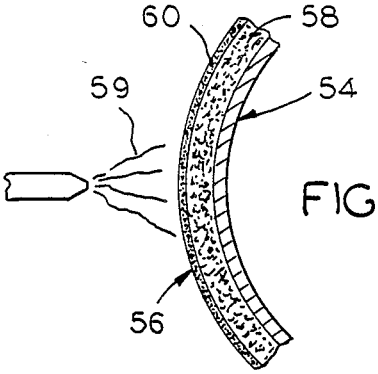
FIG. 10*d* is a partial cross sectional view illustrating still another step in the method of making a liquid storage tank in accordance with FIG. 10*a;*
Figure 10E:
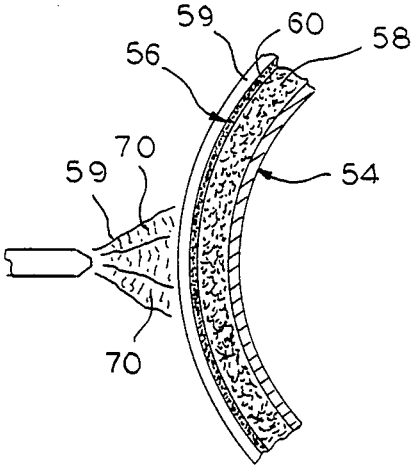
FIG. 10*e* is a partial cross sectional view illustrating a final step in the method of making a liquid storage tank in accordance with FIG. 10*a*.

For most applications, it will be desirable to form a second tank wall 68 on the composite wall 56 by first applying a first coat of the liquid resin 59 to the barrier layer 60 (see FIG. 10*d*). When this first coat has become tacky, the second tank wall 68 is completed by thereafter applying chopped fiberglass 70 together with a second coat of the liquid resin 59 to the barrier layer 60 (see FIG. 10*e*). In this connection, the first, or inner, tank wall 54 comprises a liquid-retaining wall defining a sealed chamber for retaining a liquid therewithin.

While not specifically shown, it will be appreciated that the embodiment(s) illustrated in FIGS. 9 through 11*b* can also utilize a monitor such as 22 and sensors such as 30 and 32 as described hereinabove.

Referring specifically to FIGS. 10*a* through 10*e*, the method of making the storage tank 50 for the liquid 52 can be understood as comprising the step of first providing a tank wall 54 capable of retaining the liquid 52 for storage within the tank 50. The method also includes the steps of next applying the liquid resin 59 (which may suitably be a polyester resin) to the surface 54*a* of the tank wall 54, providing a porous material 58 and forming a barrier layer 60 on one surface thereof (see FIGS. 11*a* and 11*b*), and placing the surface opposite the barrier layer 60 in contact with the liquid resin 59. In this manner, the porous material 58, which is preferably a batt formed of a needled non-woven fibrous composite material, cooperates with the liquid resin 59 form a composite wall 56 on the tank wall 54.

In this connection, the method preferably includes applying a first coat of the liquid resin 59 to the surface 54*a* of the tank wall 54, allowing the first coat to set until it becomes tacky, and then applying a second coat of the liquid resin 59 onto the surface 54*a* of the tank wall 54. The porous material or batt 58 is then placed in contact with the liquid resin 59 so as to be held in place by the tacky first coat of the liquid resin 59 while the second coat of the liquid resin 59 is penetrating into the porous material 58 to structurally bond together fibers of the porous material For most applications, the method will also include the step of forming another wall 68 on the composite wall 56 by first applying a first coat of the liquid resin 59 to the barrier layer 60 and thereafter applying a second coat of liquid resin 59 together with chopped fiberglass 70 to the barrier layer 60.

For such applications, the first coat is applied and allowed to set until it has partially cured, i.e., is no longer liquid or will no longer flow and is tacky, before the second coat is applied.

With the embodiment illustrated in FIGS. 9 through 11*b*, the extent of saturation of the porous material 58 by the resin 59 is easily controlled. This is important inasmuch as too much resin could reduce porosity to an undesirable degree whereas too little resin could fail to provide an adequate structural bond. In other words, the barrier layer 60 is advantageous in reducing the problem with manufacturing process variability.

In practice, the barrier layer 60 will only have limited porosity to restrict the amount of liquid resin 59 penetrating the porous material 58 when forming a second tank wall 68. This is preferably accomplished by utilizing a thickened latex resin to form the barrier layer 60 whereby some of the resin penetrates the porous material 58 and seals pores therein and some of the resin remains on the surface. This thickened latex resin may, by way of example, be composed of a styrene butadiene latex resin such as Genflo 3000, a silicone base water repellant such as Aurapel 376, a hydrophobic emulsion such as Auramel EM, a melamine formaldahyde resin such as Auramel M-75 and a latex thickener such as 1080 Thickener. Preferably, the barrier layer 60 is formed by roll coating the porous material 58 with such a liquid latex resin and then passing the material through an oven as a part of a continuous process.

As an alternative to the method that has been described, the barrier layer 60 could be formed in a very different manner. In particular, the porous material 58 could include upper and lower layers formed of two different fibers having different melting points, e.g., a top layer of polyester and a bottom layer of polypropylene. By taking advantage of the difference in melting points through use of a heated roller, the barrier layer 60 can be formed to control the penetration of resin therethrough.

While not previously mentioned, it will be appreciated that the inner and outer walls of the tank in all embodiments can be formed of any suitable materials. For instance, they may be formed of fiberglass, steel, aluminum, and other metals and synthetics. In addition, it will be appreciated that the inner and outer walls could be formed of different materials if desired.

With the present invention, a unique storage tank having inner and outer walls has been provided wherein a porous structural layer is bonded to the inner and outer walls therebetween. This porous structural layer is bonded to both the inner and the outer wall to achieve structural bonding that will ensure that the layers do not separate or peel apart. As a result, it is possible with the invention to reduce the strength of the liquid-retaining wall and, thus, the cost of the tank, due to the structural contributions of the porous structural layer and the outer wall.

While in the foregoing there have been set forth preferred embodiments of the invention, it will be appreciated that the details herein given are merely for purposes of illustration and may be varied by those skilled in the art without departing from the spirit and scope of the invention as defined by the appended claims.

I claim:

1. A storage tank for a liquid, comprising:

an inner wall and an outer wall in closely spaced adjacent relation, a porous, needled non-woven fibrous, material disposed between said inner and outer walls, said porous material being in intimate contact with said inner and outer walls, and a fiber-coating binder coating all fibers of said porous material, said binder also bonding all fibers of said porous material together and to said inner and outer walls, and said binder leaving small passages having a capillary characteristic between said coated and bonded fibers of said porous material.

2. The storage tank as defined by claim 1 wherein said porous material disposed between said inner and outer walls is a batt comprised of a needled non-woven fibrous composite material having inner and outer surfaces in intimate contact with said inner and outer walls.

3. The storage tank as defined by claim 1 including sensing means associated with said porous material at strategic points, said sensing means being adapted to detect the presence of a leak, said sensing means including at least one type sensor for detecting the presence of a preselected type of liquid.

4. The storage tank as defined by claim 3 wherein said sensing means includes at least two different types of sensors, one of said sensor types being adapted to detect the presence of said liquid in said storage tank, the other of said sensor types being adapted to detect the presence of another liquid normally intended to be maintained outside said storage tank.

5. In a storage tank for a liquid having an inner wall and an outer wall spaced from said inner wall, the improvement comprising a batt of porous material comprised of a needled non-woven fibrous composite material disposed between said inner and outer walls, said composite material containing a fiber-coating binder coating and bonding all fibers of said composite material together, said binder leaving small passages having a capillary characteristic between said coated and bonded fibers of said composite material, said batt being in intimate contact with said inner and outer walls and being adapted to wick any liquid coming into contact therewith, sensing means associated with said batt at strategic points relative to said inner and outer walls for detecting the presence of a leak, and means associated with said sensing means for indicating the presence of said leak.

6. The storage tank as defined by claim 5 wherein said sensing means includes at least two different types of sensors with one type sensor detecting the presence of one type liquid and the other type sensor detecting the presence of another type liquid.

7. The storage tank as defined by claim 6 wherein said one type sensor detects the presence of said liquid in said storage tank in the event said liquid in said storage tank should leak through said inner wall and the other type sensor detects the presence of another liquid normally intended to be maintained outside said storage tank in the event said other liquid should leak through said outer wall.

8. In a storage tank for a liquid having an inner wall and an outer wall spaced from said inner wall, the improvement comprising a batt of porous material comprised of a needled non-woven fibrous composite material disposed between said inner and outer walls, said batt having inner and outer surfaces in intimate contact with confronting spaced apart surfaces of said inner and outer walls, respectively, and having the characteristic of wicking any liquid coming in contact therewith, said composite material containing a fiber-coating binder coating and bonding all fibers of said composite material together, said binder leaving small passages having a capillary characteristic between said coated and bonded fibers of said composite material, sensing means mounted in strategic points about both said inner and outer surfaces of said batt for detecting the presence of any liquid leaking through either of said inner and outer walls of said tank, and means operatively associated with said sensing means for warning of the presence of any leaking liquid.

9. The storage tank as defined by claim 8 wherein said sensing means includes at least two different types of sensors with one type sensor detecting the presence of one type liquid and the other type sensor detecting the presence of another type liquid, said one type sensor detecting the presence of said liquid in said storage tank in the event said liquid in said storage tank should leak through said inner wall, the other type sensor detecting the presence of another liquid normally intended to be maintained outside said storage tank in the event the other liquid should leak through said outer wall.

10. A method of making a storage tank for a liquid comprising the steps of laying up a shell forming one wall of said tank, applying a porous, needled non-woven fibrous, material to one surface of said one wall of said tank; forming a structural bond by applying a fiber-coating binder to coat and bond all fibers of said porous material together and to said one wall, said binder leaving small passages having a capillary characteristic between said coated and bonded fibers of said porous material, laying up another shell on said porous material to form another wall of said tank bonded to said porous material.

11. The method of making a storage tank as defined by claim 10 wherein said porous material is a batt formed of a needled non-woven fibrous composite material having inner and outer surfaces, said batt being applied to said one wall of said tank by placing one of said surfaces of said batt in contact with said one surface of said one wall of said tank.

12. The method of making a storage tank as defined by claim 10 wherein said structural bond is formed by first applying said binder to said one surface of said one wall of said tank, next applying one surface of said porous material to said binder coated surface, next applying said binder to the other surface of said porous material, and then forming said other wall on the other surface of said porous material.

13. The method of making a storage tank as defined by claim 11 including the step of first saturating said batt with a fiber-coating binder to substantially coat fibers of said composite material with said binder so as to bond said fibers together.

14. The method of making a storage tank as defined by claim 13 including the step of next removing excess fiber-coating binder from said batt by compressing said batt after saturation to ensure that said fibers are coated and bonded together.

15. The method of making a storage tank as defined by claim 14 wherein the step of applying said batt is performed before said fiber-coating binder cures, and including the step of forming a skin on the other of said surfaces of said batt.

16. The method of making a storage tank as defined by claim 15 wherein the step of laying up the other shell on said batt is performed before said fiber-coating binder cures, the other shell being laid up on said skin on the other of said surfaces of said batt.

17. The method of making a storage tank as defined by claim 13 including the step of next removing excess fiber-coating binder from said batt by allowing a solvent in said binder to evaporate after saturation to ensure that said fibers are coated and bonded together.

18. The method of making a storage tank as defined by claim 10 including the steps of installing at least one type of liquid sensor in said porous material so as to be positioned between said shells at strategic points to detect the presence of a leak.

19. The method of making a storage tank as defined by claim 18 wherein said one type of sensor detects the presence of said liquid in said storage tank in the event said liquid in said storage tank should leak through an inner one of said walls.

20. The method of making a storage tank as defined by claim 19 including the step of installing a second type of sensor for detecting the presence of another liquid normally intended to be maintained outside said storage tank in the event of a leak through an outer one of said walls.

21. The method of making a storage tank as defined by claim 10 including the step of first forming a film on one surface of said porous material capable of subsequently resisting penetration of said fiber-coating binder.

22. A storage tank for a liquid, comprising:

a tank wall and a composite wall formed thereon;

said composite wall being applied to said tank wall by first applying a liquid resin to a surface of said tank wall, said composite wall comprising a pours batt comprised of a needled non-woven fibrous composite material having a barrier layer formed on one surface thereof by first coating said one surface of said composite wall with a liquid resin and by then heating said one surface of said composite wall having said liquid resin, said composite wall being placed on said tank wall with the surface opposite said barrier layer in contact with said liquid resin, said liquid resin coating and bonding together all fibers of said composite material inwardly of said barrier layer while leaving small passages having a capillary characteristic between said coated and bonded fibers of said composite material.

23. The storage tank as defined by claim 22 wherein said liquid resin used to coat said one surface of said composite wall is a latex resin.

24. The storage tank as defined by claim 22 wherein a first coat of said liquid resin is applied to said surface of said tank wall, said first coat being allowed to set until it becomes tacky, and then a second coat of said liquid resin is applied to said surface of said tank wall.

25. The storage tank as defined by claim 24 wherein said liquid resin applied to said surface of said tank wall is a polyester resin.

26. The storage tank as defined by claim 24 wherein said composite wall is placed on said tank wall so as to be held in place by said tacky first coat of said liquid resin while said second coat of said liquid resin on said tank wall is penetrating into said composite wall.

27. The storage tank as defined by claim 26 wherein said barrier layer is formed prior to applying said composite wall to said tank wall by first coating said one surface of said composite wall with a liquid resin and by then heating said one surface of said composite wall having said liquid resin.

28. The storage tank as defined by claim 26 including a second tank wall on said composite wall, said second tank wall being formed by first applying a first coat of a liquid resin to said barrier layer, said second tank wall being completed by thereafter applying a second coat of a liquid resin and chopped fiberglass to said barrier layer.

29. The storage tank as defined by claim 28 wherein one of said tank walls is an inner wall and the other of said tank walls is an outer wall.

30. The storage tank as defined by claim 29 wherein said inner wall comprises a liquid-retaining wall defining a sealed chamber for retaining a liquid therewithin.

31. A method of making a storage tank for a liquid, comprising the steps of:

providing a tank wall and a fibrous porous material;

forming a barrier layer on said porous material substantially reducing porosity of one surface thereof;

applying a first coat of liquid resin to a surface of said tank wall, allowing said first coat to set until it becomes tacky, and applying a second coat of said liquid resin onto said surface of said tank wall; and placing the surface of said porous material opposite said barrier layer in contact with said liquid resin so as to be held in place by said tacky first coat of said liquid resin while said second coat of said liquid resin is penetrating into said porous material to coat and structurally bond together all fibers thereof while leaving small passages having a capillary characteristic between said bonded fibers of said porous material;

whereby said porous material and liquid resin form a composite wall on said tank wall.

32. The method of making a storage tank as defined by claim 31 wherein said porous material is a batt formed of a needled non-woven fibrous composite material.

33. The method of making a storage tank as defined by claim 31 wherein said barrier layer is formed by first coating said one surface of said porous material with a liquid resin and by then heating said one surface of said porous material to substantially reduced porosity of said porous material at said one surface thereof.

34. The method of making a storage tank as defined by claim 31 including the step of forming a second tank wall on said composite wall, said second tank wall being formed by first applying a first coat of liquid resin to said barrier layer, said second tank wall being formed by thereafter applying a second coat of a liquid resin and chopped fiberglass to said barrier layer.

35. The method of making a storage tank as defined by claim 34 wherein one of said tank walls is an inner wall and the other of said tank walls is an outer wall.

36. The method of making a storage tank as defined by claim 35 wherein said inner wall comprises a liquid-retaining wall defining a sealed chamber for retaining a liquid therewithin.

* * * * *